United States Patent [19]

Rains et al.

[11] 3,971,681

[45] July 27, 1976

[54] COMPOSITE DOUBLE BASE PROPELLANT WITH TRIAMINOGUANIDINIUM AZIDE

[75] Inventors: William A. Rains; Robert D. Fox; James P. Flynn, all of Midland, Mich.

[73] Assignee: The Dow Chemical Company, Midland, Mich.

[22] Filed: Jan. 24, 1962

[21] Appl. No.: 175,382

[52] U.S. Cl. ..... 149/19.8; 149/35; 149/38; 149/76; 149/98; 149/100

[51] Int. Cl. ..... C06d 5/06

[58] Field of Search ..... 149/35, 76, 43, 100, 149/108, 98, 19, 38

[56] References Cited

UNITED STATES PATENTS

| | | | |
|---|---|---|---|
| 1,428,011 | 9/1922 | Dehn | 149/76 X |
| 3,035,948 | 5/1962 | Fox | 149/76 X |
| 3,044,911 | 7/1962 | Fritzlen | 149/43 X |
| 3,050,423 | 8/1962 | Hudson | 149/76 X |

*Primary Examiner*—Carl D. Quarforth
*Assistant Examiner*—E.A. Miller
*Attorney, Agent, or Firm*—C. Kenneth Bjork

EXEMPLARY CLAIM

1. A solid rocket propellant composition which consists essentially of from about:
   1. 30–60 weight per cent of a double base propellant
   2. 5–30 weight per cent of a finely divided metal fuel
   3. 5–30 weight per cent of an inorganic oxidizer
   4. 10–30 weight per cent of triaminoguanidinium azide.

7 Claims, No Drawings

COMPOSITE DOUBLE BASE PROPELLANT WITH TRIAMINOGUANIDINIUM AZIDE

This invention relates to rocket propellants and more particularly is concerned with an improved double base propellant system containing triaminoguanidinium azide. The term double based propellant as is understood in the propellant art and used herein means nitrocellulose having a nitroglycerin or analogous nitrated polyhydroxy based plasticizer or a mixture of plasticizers as a second combustible ingredient.

The performance of such double base propellant systems, e.g. (nitrocellulose-trimethylolethane trinitrate, nitrocellulose-nitroglycerin and the like) can be improved by adding other fuels such as aluminum, magnesium, decaborane diammoniate, beryllium and the like, for example, and other oxidizers including, for example, ammonium nitrate, ammonium perchlorate, hydrazine nitroformate etc. to the double base system. In such fuel-oxidizer-double base systems the organic double base serves the additional purpose of being a binder for the added fuel and oxidizer components in the propellant grain.

Of such multi-component propellants, those containing aluminum-ammonium perchlorate and a double base binder are of wide spread interest. These systems show optimum specific impulses of about 265 seconds with chamber temperatures of about 3700°K. The specific impulses of double-base systems themselves ordinarily range from about 230 seconds up to a maximum theoretical value of about 250 seconds.

Although a respectable increase in specific impulse is indicated by the metallized double base system over that shown by the organic double base itself, such propellants, because of the elevated chamber temperatures during combustion may undergo dissociation processes that could have detrimental effects upon the impulse.

Now, unexpectedly it has been found that adding triaminoguanidinium azide to metallized-inorganic oxidizer-double base propellants provides lower chamber temperatures, increases the amount of low molecular weight gases and gives higher specific impulses than have been achieved heretofore with these systems.

It is a principal object of the present invention, therefore, to provide a double base propellant composition having unexpectedly high performance characteristics.

It is another object of the present invention to provide a thrust producing additive for metallized-inorganic oxidizer-double base propellants which is compatible with the nitrocellulose binder system.

It is a further object of the present invention to provide a double base propellant composition which has a high specific impulse.

It is an additional object of the present invention to provide a solid propellant grain that is easily formulated and which can be readily stored for extended periods of time.

The present invention comprises a metallized-inorganic oxidizer-double base propellant system containing from about 10 to about 30 per cent, based on the final propellant weight of triaminoguanidinium azide. Ordinarily from about 15 to about 25 per cent of this amine azide will be incorporated into the propellant and preferably from about 18 to about 22 per cent by weight of this compound will be incorporated into the system.

The improved propellant of the instant invention, in addition to the triaminoguanidine azide contains ordinarily from about 30 to about 60 per cent of the double base propellant, from about 5 to about 30 per cent of finely divided metal and from about 5 to about 30 per cent inorganic oxidizer.

Preferably the binder will comprise a mixture of 1 part by weight plastisol grade nitrocellulose and from about 1.5 to about 3 parts by weight nitrated polyhydroxy alcohol based plasticizer. Although plasticizers, such as triethylene glycol dinitrate or nitroglycerin work satisfactorily in the instant compositions, more energetic nitroplasticizers such as trimethylolethane trinitrate preferably are employed.

Finely divided metals ordinarily employed as fuels are aluminum, magnesium and beryllium and the inorganic oxidizer ordinarily used is ammonium perchlorate.

In formulating the propellant grain the nitrocellulose, metal, triaminoguanidinium azide, and inorganic oxidizer can be dry-blended. The plasticizer then is added with mixing and the resulting paste allowed to cure. Alternatively, the double-base propellant mixture can be prepared and the metal fuel, inorganic oxidizer and triaminoguanidinium azide then be mixed into the binder and the whole mass cured.

With binders such as plastisol grade nitrocellulose and triethylene glycol dinitrate a rubbery elastomer results with a room temperature cure. Substantially no undesirable gas-producing reaction is observed in the triaminoguanidinium azide containing propellants during this relatively low temperature cure. However, when such a system is cured at about 50°C. or higher, a minor amount of undesirable gas producing reaction occurs. Heating a room temperature cured propellant at 50°C. for several hours does not produce gassing of the grain. For those compositions having binders which must be cured at elevated temperatures, for example, trimethylethane trinitrate, the undesirable gas forming reaction produced during cure can be eliminated by adding from about 1 to about 2 per cent of a diisocyanate, such as m-xylene diisocyanate, toluene diisocyanate etc. to the formulation.

Alternatively, the compatability problem existing between the triaminoguanidinium azide and the double base binder while curing at the elevated temperature can be eliminated by coating the triaminoguanidinium azide prior to incorporating it into the mix. Organic polymers such as saran, sperm waxes and cottonseed waxes either alone or in combination can be used to coat the azide particles. Also vacuum deposited aluminum coating can be employed.

If the metal fuel additive is left out of the propellants described hereinbefore, the resultant product can be used as a solid gas generator or as a smokeless solid propellant having a specific impulse somewhat lower than shown for the metallized compositions.

The following examples will serve to further illustrate the present invention but are not meant to limit it thereto.

EXAMPLE 1

Twelve grams of plastisol grade nitrocellulose, 28 grams of trimethylolethane trinitrate and 2 grams of toluenediisocyanate were blended together. Twenty grams of powdered (Alcoa 123 grade) and 20 grams of a particulated triaminoguanidinium azide were mixed into the binder followed by 20 grams of particulate ammonium perchlorate. The resulting formulation was cured for approximately 16 hours within a temperature range of from about 50° to about 70°C. The resulting substantially voids-free elastomeric grain was static test fired and burned smoothly. This formulation has a theoretical specific impulse of 276 seconds at a combustion chamber temperature of about 3480°K.

EXAMPLE 2

A number of propellants were prepared following the procedure and employing the components described for Example 1 wherein the weight per cent of the components was varied.

Table I, which follows, lists these propellant formulations and summarizes their combustion characteristics.

TABLE I

| Run No. | Propellant Components[5] (weight per cent) Al | TAZ[1] | NC[2] | AP[3] | TMETN[4] | Combustion Chamber Temp (°K) | Calculated Isp. (Sec.) |
|---|---|---|---|---|---|---|---|
| 1 | 17 | 26 | 12 | 17 | 28 | 3297 | 275 |
| 2 | 14 | 32 | 12 | 14 | 28 | 3094 | 271 |
| 3 | 18 | 20 | 12 | 22 | 28 | 3489 | 276 |
| 4 | 22 | 20 | 12 | 18 | 28 | 3426 | 273 |
| 5 | 16 | 20 | 12 | 24 | 28 | 3466 | 274 |

[1]Triaminoguanidinium Azide
[2]Nitrocellulose-Plastisol Grade
[3]Ammonium Perchlorate
[4]Trimethylolethane Trinitrate containing about 10% Triethyleneglycol dinitrate
[5]2 grams toluenediisocyanate blended with NC and TMETN

EXAMPLE 3

A number of propellant compositions were prepared employing the same components and procedures as described for that of Example 1, except particulate, milled beryllium metal was substituted for the aluminum metal.

The formulation compositions and their combustion characteristics are summarized in Table II which follows:

TABLE II

| Run No. | Propellant Components[5] (weight per cent) Be | TAZ[1] | NC[2] | AP[3] | TMETN[4] | Combustion Chamber Temp (°K) | Calculated Isp. (Sec.) |
|---|---|---|---|---|---|---|---|
| 1 | 13 | 20 | 12 | 27 | 28 | 3583 | 292 |
| 2 | 10 | 20 | ↓ | 30 | ↓ | 3538 | 289 |
| 3 | 16 | 20 | ↓ | 24 | ↓ | 3423 | 285 |
| 4 | 10 | 18 | ↓ | 32 | ↓ | 3573 | 288 |
| 5 | 13 | 18 | ↓ | 29 | ↓ | 3651 | 291 |
| 6 | 16 | 18 | ↓ | 26 | ↓ | 3454 | 284 |
| 7 | 15 | 22 | ↓ | 23 | ↓ | 3392 | 285 |
| 8 | 12 | 22 | ↓ | 26 | ↓ | 3550 | 292 |
| 9 | 9 | 22 | ↓ | 29 | ↓ | 3464 | 287 |

[1]Triaminoguanidium Azide
[2]Nitrocellulose-Plastisol Grade
[3]Ammonium Perchlorate
[4]Trimethylolethane Trinitrate containing about 10% Triethyleneglycol dinitrate
[5]2 grams toluenediisocyanate blended with NC and TMETN

EXAMPLE 4

A propellant grain weighing 167 grams and containing on a weight basis 30 per cent triethylene glycol dinitrate, 10 per cent plastisol grade nitrocellulose, 22 per cent ammonium perchlorate, 18 per cent finely divided aluminum (Alcoa 123 grade) and 20 per cent particulate triaminoguanidinium azide was cured at room temperature for about 2 days. Smooth combustion of the cured grain was obtained in a rocket motor.

This propellant had a calculated specific impulse of 272 at a combustion chamber temperature of about 3344°K.

In a manner similar to that described for the foregoing examples triaminoguanidinium azide can be incorporated into an aluminum-ammonium nitrate-double base system employing a plastisol grade nitrocellulose and nitroglycerine as a binder. The specific impulse of a magnesium-ammonium perchlorate-nitrocellulose-triethylene glycol dinitrate double base propellant can be increased by blending triaminoguanidinium azide into the formulation.

It is apparent to one skilled in the art that a double base propellant can consist of nitrocellulose plasticized with one or more nitrated polyhydroxy based plasticizers. In addition to the individual plasticizer listed in the examples presented hereinbefore, mixtures of these plasticizing materials e.g. triethylene glycol dinitrate and trimethylolethane trinitrate, can be employed.

Various modifications can be made in the present invention without departing from the spirit or scope thereof for it is understood that we limit ourselves only as defined in the appended claims.

We claim:

1. A solid rocket propellant composition which consists essentially of from about:

1. 30–60 weight per cent of a double base propellant
2. 5–30 weight per cent of a finely divided metal fuel
3. 5–30 weight per cent of an inorganic oxidizer
4. 10–30 weight per cent of triaminoguanidinium azide.

2. The propellant composition as defined in claim 1 wherein the metal is a member selected from the group consisting of aluminum, magnesium, and beryllium and the inorganic oxidizer is a member selected from the group consisting of ammonium perchlorate and ammonium nitrate.

3. The rocket propellant as defined in claim 1 wherein the double base propellant consists of about 1 part by weight plastisol grade nitrocellulose and from about 1.5 to about 3 parts by weight nitrated polyhydroxy alcohol based plasticizer.

4. A solid rocket propellant composition which consists essentially of about 40 weight per cent of a double base propellant, 20 weight per cent finely divided aluminum, 20 weight per cent ammonium perchlorate and about 20 weight per cent triaminoguanidinium azide, said double base propellant comprising 1 part by weight plastisol grade nitrocellulose and from about 1.5 to about 3 parts by weight nitrated polyhydroxy alcohol based plasticizer.

5. A solid rocket propellant which consists essentially of:

1. about 12 weight per cent plastisol grade nitrocellulose
2. about 28 weight per cent trimethylolethane trinitrate
3. from about 14 to about 22 weight per cent finely divided aluminum 4. from about 14 to about 22 weight per cent ammonium perchlorate
5. from about 20 to about 32 weight per cent triaminoguanidinium azide, and about 2 per cent on the weight of said propellant of toluenediisocyanate.

6. A solid rocket propellant which consists essentially of:

1. about 12 weight per cent plastisol grade nitrocellulose
2. about 28 weight per cent trimethylolethane trinitrate
3. from about 9 to about 16 weight per cent finely divided beryllium
4. from about 23 to about 32 weight per cent ammonium perchlorate
5. from about 18 to about 22 weight per cent triaminoguanidinium azide, and about 2 per cent on the weight of said propellant of toluenediisocyanate.

7. A solid propellant consisting essentially of about 30 parts triethylene glycol dinitrate, about 10 parts plastisol grade nitrocellulose, about 22 parts ammonium perchlorate, about 18 parts finely divided aluminum and about 20 parts triaminoguanidinium azide.

* * * * *